US008624512B2

(12) United States Patent
Li

(10) Patent No.: US 8,624,512 B2
(45) Date of Patent: Jan. 7, 2014

(54) CIRCUIT FOR ELIMINATING THRESHOLD VOLTAGE DIFFERENCE BETWEEN BACKLIGHT LED STRINGS AND LIQUID CRYSTAL DISPLAY USING THE SAME

(75) Inventor: Fei Li, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 204 days.

(21) Appl. No.: 13/380,896

(22) PCT Filed: Oct. 27, 2011

(86) PCT No.: PCT/CN2011/081410

§ 371 (c)(1),
(2), (4) Date: Dec. 26, 2011

(87) PCT Pub. No.: WO2013/037155

PCT Pub. Date: Mar. 21, 2013

(65) Prior Publication Data

US 2013/0063036 A1 Mar. 14, 2013

(30) Foreign Application Priority Data

Sep. 13, 2011 (CN) ..... 2011 2 0341874

(51) Int. Cl.
*H05B 37/00* (2006.01)

(52) U.S. Cl.
USPC ..... 315/192; 315/291; 315/307

(58) Field of Classification Search
USPC ..... 315/185 R, 192, 193, 291, 294, 295, 315/297, 299–302, 306, 307, 246
See application file for complete search history.

(56) References Cited

U.S. PATENT DOCUMENTS

| | | | | |
|---|---|---|---|---|
| 6,734,639 | B2 * | 5/2004 | Chang et al. | 315/291 |
| 7,940,014 | B2 * | 5/2011 | Shin et al. | 315/294 |
| 8,058,817 | B2 * | 11/2011 | Lipcsei et al. | 315/297 |
| 2010/0033110 | A1 * | 2/2010 | Chien | 315/294 |

FOREIGN PATENT DOCUMENTS

CN 101808444 A 8/2010

OTHER PUBLICATIONS

International Search Report of the PCT Application No. PCT/CN2011/081410, international filing date Oct. 27, 2011.

* cited by examiner

*Primary Examiner* — James H Cho

(57) ABSTRACT

The circuit eliminating threshold voltage differences between backlight LED strings includes a voltage supply input, a number of first switching units, and a number of LED strings. The LED strings are connected to each other in parallel, and one end of each LED string is connected to the voltage supply input and the other end thereof is connected to the corresponding first switching unit. The constant current controller includes a constant current source for supplying a constant current to each LED string, a current detector for detecting a working current of each LED string, a comparator for comparing the working current of each LED string and the constant current, and outputting a comparing result, and a square wave generator for outputting driving signals of different frequencies each which is capable of driving the corresponding LED string to work at the corresponding frequency.

16 Claims, 1 Drawing Sheet

CIRCUIT FOR ELIMINATING THRESHOLD VOLTAGE DIFFERENCE BETWEEN BACKLIGHT LED STRINGS AND LIQUID CRYSTAL DISPLAY USING THE SAME

BACKGROUND

1. Technical Field

The present disclosure relates to liquid crystal displaying technologies, and particularly, to a circuit for eliminating threshold voltage differences between backlight LED strings and a liquid crystal display using the same.

2. Description of Related Art

Due to advantages of light emitting diodes (LEDs) such as long lasting, energy saving, and easily to be driven, LEDs are widely used in various electronic devices, such as backlight modules of liquid crystal displays (LCDs). The backlight module generally includes edge-lighting type backlight modules and direct type backlight modules. In the direct type backlight modules, the LEDs are located under the liquid crystal panel. In the edge-lighting type of the backlight modules, a number of LED strings are disposed around a liquid crystal panel of the LCD. Each of the LED string includes a number of LEDs connected in series.

In the manufacturing process of the LED backlight modules, the LEDs are connected in series to from the LED strings respectively. Due to the different manufacturing technology, threshold voltages of the LED strings may be different from each other to result in a threshold voltage difference between two LED strings. This may further result in energy consumptions on MOS transistors respectively connected to the LED strings and further increases of the temperatures of the MOS transistors. In this state, not only the performance of the MOS transistors are influenced, but also constant current integrated circuits used for respectively controlling the LED strings are heated to consume energy, which reduces efficiency of the backlight module.

Generally, a current of each of the LED strings can be increased and an on state duration t or a duty ratio D of each of the LED strings can be reduced to reduce the voltage differences between the LED strings.

To a first LED string, according to the calculating formula of the duty ratio D: D=t/T=t*F, (wherein t refers to the on state duration, T refers to an on state period, and F refers to a threshold frequency), when the threshold voltage (labeled as $V_f$) equal to 40V, the current I is equal to 10 mA, the on state duration t is equal to 1 s, and the on state period T is equal to 10 s, the duty ratio D of the first LED string can be calculated to be 10% and a threshold energy for turning on the first LED string reaches 0.4 J according to the following expression: $W=V_f*I*D*T=0.4$ J.

Due to the manufacturing difference between the LED strings, the threshold energy for turning on a second LED string can reach W=0.75 J when the threshold voltage $V_f$ thereof is equal to 50V, the current I thereof is equal to 15 mA, and the duty ratio D is the same as that of the first LED string. Therefore, the threshold energies of the two LED strings are different from each other and the brightness of the two LED strings may become different from each other.

In other situations, the on state duration t may be changed to adjust the duty ratio D to allow the threshold energy of the second LED string to reach 0.4 J, thus, the threshold energy of the second LED string can keep the same as that of the first LED string.

However, the on state duration t cannot be reduced unlimitedly due to the interior structure of the constant current integrated circuit, therefore, the energy consumption of each of the LED strings cannot be reduced unlimitedly.

Therefore, there is room for improvement in the art.

SUMMARY

The present disclosure provides a circuit for eliminating threshold voltage differences between backlight LED strings. The circuit includes a voltage supply input, a number of first switching units, and a number of LED strings. The LED strings are connected to each other in parallel, and one end of each of the LED strings is connected to the voltage supply input and the other end thereof is connected to the corresponding first switching unit. The constant current controller includes a constant current source for supplying a constant current to each of the LED strings, a current detector for detecting a working current of each of the LED strings, a comparator for comparing the working current of each of the LED strings with the constant current from the constant current source, and outputting a comparing result, and a square wave generator for outputting driving signals of different frequencies each which is capable of driving the corresponding LED string to work at the corresponding frequency of the corresponding driving signal.

Preferably, each of the first switching units is a MOS transistor with a drain thereof connected to the corresponding LED string, a gate connected to the square wave generator, and a source thereof connected to current detector; and the comparator is connected to the current detector, the constant current source, and the square wave generator.

Preferably, the circuit further includes a first resistor with one end thereof connected to the constant current source and the other end thereof being grounded.

Preferably, the circuit further includes a number of second resistors, one end of each of the second resistors is connected to the source of the corresponding first switching unit, and the other end of each of the second resistors is grounded.

Preferably, the square wave generator includes a number of second switching units and a number of oscillators, each of the second switching units is a MOS transistor with the gate thereof connected to the comparator, the drain thereof connected to the corresponding oscillator, and the source thereof being grounded, and each of the oscillators is further connected to the gate of the corresponding first switching unit for outputting the driving signal according to an output impedance of the corresponding second switching unit.

Preferably, the square wave generator further includes a number of amplifiers respectively corresponding to the oscillators, each of the amplifiers is connected between the corresponding oscillator and the gate of the corresponding first switching unit of the corresponding LED string for amplifying the driving signal outputted from the corresponding oscillator.

Preferably, the first switching units and the second switching units are n-channel type MOS transistors.

Preferably, the oscillators are crystal oscillators.

Preferably, the circuit further includes a constant current integrated circuit, and the constant current integrated circuit includes the constant current controller and the first switching units.

The present disclosure further provides a liquid crystal display having a circuit for eliminating threshold voltage differences between backlight LED strings. The circuit includes a voltage supply input, a number of first switching units, and a number of LED strings. The LED strings are connected to each other in parallel, and one end of each of the LED strings is connected to the voltage supply input and the other end thereof is connected to the corresponding first switching unit. The constant current controller includes a constant current source for supplying a constant current to each of the LED strings, a current detector for detecting a working current of each of the LED strings, a comparator for comparing the working current of each of the LED strings with the constant current from the constant current source, and outputting a comparing result, and a square wave generator for outputting driving signals of different frequencies each which is capable of driving the corresponding LED string to work at the corresponding frequency of the corresponding driving signal.

Preferably, each of the first switching units is a MOS transistor with a drain thereof connected to the corresponding LED string, a gate connected to the square wave generator, and a source thereof connected to current detector; and the comparator is connected to the current detector, the constant current source, and the square wave generator.

Preferably, the circuit further includes a first resistor with one end thereof connected to the constant current source and the other end thereof being grounded.

Preferably, the circuit further includes a number of second resistors, one end of each of the second resistors is connected to the source of the corresponding first switching unit, and the other end of each of the second resistors is grounded.

Preferably, the square wave generator includes a number of second switching units and a number of oscillators, each of the second switching units is a MOS transistor with the gate thereof connected to the comparator, the drain thereof connected to the corresponding oscillator, and the source thereof being grounded, and each of the oscillators is further connected to the gate of the corresponding first switching unit for outputting a corresponding driving signal according to an output impedance of the corresponding second switching unit.

Preferably, the square wave generator further includes a number of amplifiers respectively corresponding to the oscillators, each of the amplifiers is connected between the corresponding oscillator and the gate of the corresponding first switching unit of the corresponding LED string for amplifying the driving signal outputted from the corresponding oscillator.

Preferably, the first switching units and the second switching units are n-channel type MOS transistors.

Preferably, the circuit further includes a constant current integrated circuit, and the constant current integrated circuit includes the constant current controller and the first switching units.

In the constant current controller of the present disclosure, the constant current source is capable of supplying the constant current to each of the LED strings, the current detector is capable of detecting the working current of each of the LED strings, and the comparator is capable of comparing the constant current and the working current of each of the LED strings and generating a corresponding driving signal based on the detecting result and driving the corresponding MOS transistor to work at the corresponding frequency. Thus, the threshold frequencies of the MOS transistors can be changed to adjust the on state periods thereof respectively. In this way, the threshold voltage difference between the LED strings is eliminated to allow the LEDs of each of the LED strings to have the same brightness level. This reduces the energy consumption and the temperature of the constant current IC, and improves the energy converting efficiency and the performance of the MOS transistors.

BRIEF DESCRIPTION OF DRAWINGS

Many aspects of the embodiments can be better understood with reference to the following drawing. The components in the drawings are not necessarily drawn to scale, the emphasis instead being placed upon clearly illustrating the principles of the embodiments. Moreover, in the drawings, like reference numerals designate corresponding pats throughout two views.

DETAILED DESCRIPTION

The disclosure is illustrated by way of example and not by way of limitation in the figures of the accompanying drawing in which like references indicate similar elements. It should be noted that references to "an" or "one" embodiment in this disclosure are not necessarily to the same embodiment, and such references mean at least one.

Figure 1:
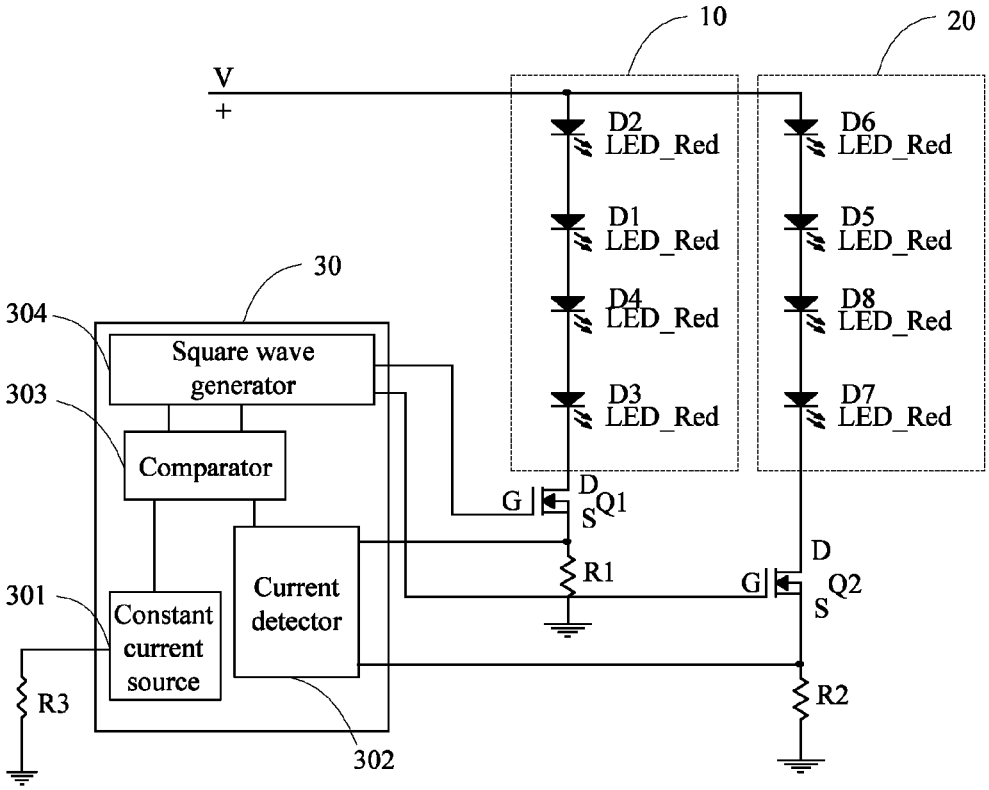
FIG. 1 is a block diagram of a circuit for eliminating a threshold voltage difference between two backlight LED strings in accordance with an embodiment of the present disclosure, and the circuit includes a constant current controller with a square wave generator.

Referring to FIG. 1, a circuit is used for eliminating a threshold voltage difference between two backlight LED strings. The circuit includes a first LED string 10, a second LED string 20 connected to the first LED string 10 in parallel, two first switching units (labeled as Q1 and Q2 in the embodiment) respectively connected to the first and second LED strings 10, 20, a first resistor R1 connected to one of the first switching units, and a second resistor R2 connected to the other one of the first switching units. It is noted the number of the LED string is not limited to this embodiment. In other embodiments, the circuit may include more than two LED strings.

One ends of the two LED strings 10, 20 are connected to a voltage supply input V+. Each of the LED strings includes a number of LEDs connected to each other in series. For example, in the embodiment, the first LED string 10 includes a second LED D2 with an anode thereof connected to the voltage supply input V+, and a first LED D1, a forth LED D4, and a third LED D3 connected to an cathode of the second LED D2 in series. The second LED string 20 includes a sixth LED D6 with the anode thereof connected to the voltage supply input V+, and a fifth LED D5, an eighth LED D8 and a seventh LED D7 connected to the cathode of the sixth LED D6 in series.

The two switching units Q1, Q2 are both n-channel type metal oxide semiconductor field effect (NMOS) transistors and are respectively connected to the other ends of the two LED strings 10, 20. A drain D of the switching unit Q1 is connected to the cathode of the third LED D3 and a source S thereof is grounded via the first resistor R1. A drain D of the switching unit Q2 is connected to the cathode of the seventh LED D7 and a source S thereof is grounded via the second resistor R2.

Since one ends of the two LED strings 10, 20 are respectively connected to the same voltage supply input V+, therefore, voltages respectively inputted to the LED strings 10, 20 are the same as each other. However, due to the difference in the manufacturing technology, threshold voltages of the two LED strings 10, 20 are different from each other. This results in the difference between the voltages being respectively applied to the two switching units Q1, Q2. Thus, the energy consumptions on the two switching units Q1, Q2 in an on state period of the LED strings 10, 20 are also different from each other.

According to the relationship between a duty ratio D and a threshold frequency F of a MOS transistor: D=t*F, the duty ratio D of each of the first switching units can be adjusted by changing the threshold frequency F thereof to further eliminate the threshold voltage difference between the two LED strings 10 and 20. In this way, the two LED strings 10, 20 can have the same brightness level, and the energy consumption on each of the LED strings can be reduced, and the energy converting efficiency can be further improved.

In order to eliminate the threshold voltage difference between the two LED strings 10, 20, the circuit further includes a constant current controller 30 connected to the two first switching units Q1, Q2 for controlling the threshold frequencies of the two switching units Q1, Q2. The constant current controller 30 includes a constant current source 301, a third resistor R3, a current detector 302, a comparator 303, and a square wave generator 304. It is noted that in other embodiments, the constant current controller 30 may be disposed in a constant current integrated circuit (IC), or the two switching units Q1, Q2 and the constant current controller 30 may be disposed in the constant current IC.

The constant current source 301 is used for supplying constant currents to the two LED strings 10, 20 respectively. One end of the third resistor R3 is connected to the constant current source 301 and the other end thereof is grounded. The current detector 302 is connected to the sources of the two switching units Q1, Q2 for detecting the working currents of the two switching units Q1, Q2 respectively. The comparator 303 is connected to the constant current source 301 and the current detector 302 for respectively receiving the constant current from the constant current source and the working currents of the two LED strings 10, 20. The comparator 303 is capable of comparing the constant current with the working current, and generating a comparing result. The square wave generator 304 is connected to the comparator 303 for receiving the comparing result and generating two corresponding driving signals to respectively drive each of the switching units Q1, Q2 to work at the corresponding frequency.

Figure 2:
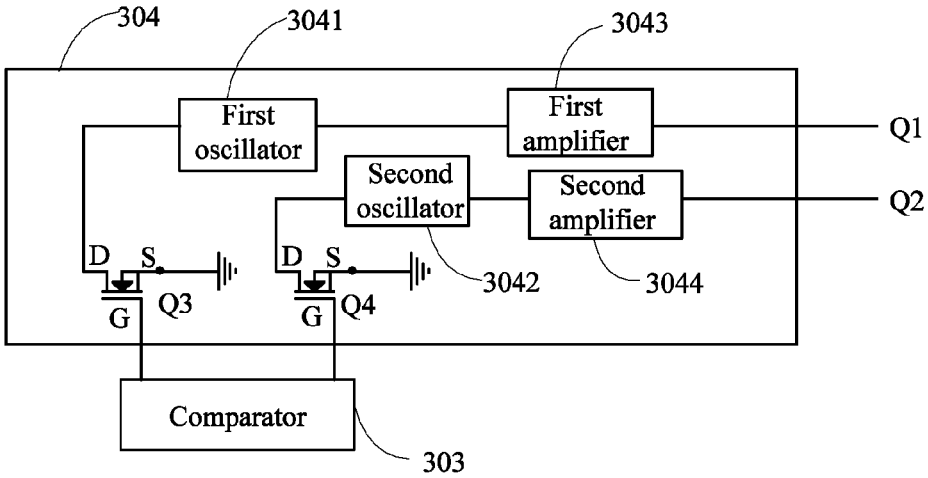
FIG. 2 is a block diagram of the square wave generator of FIG. 1.

Referring to FIG. 2, the square wave generator 304 includes two second switching units (labeled as Q3 and Q4 in the embodiment), a first oscillator 3041, a second oscillator 3042, a first amplifier 3043, and a second amplifier 3044. In the embodiment, the two switching units Q3, Q4 are NMOS transistors. And the first and second oscillators 3041, 3042 are crystal oscillators of high precision and high stability which are commonly used in various kinds of oscillating circuits and telecommunication systems. It is noted that the number of the second switching units, the oscillators, and the amplifiers are not limited to this embodiment. In some embodiments, the square wave generator 304 may include more than two second switching units, more than two oscillators, and more than two amplifiers.

The two switching units Q3, Q4 are connected to the comparator 303 for receiving the comparing result from the comparator 303. In this state, the output impedances of the two switching units Q3, Q4 are respectively changed according to the comparing result. Specifically, both gates G of the two switching units Q3, Q4 are connected to the comparator 303, and both sources S thereof are grounded. The first oscillator 3041 and the second oscillator 3042 are respectively connected to the drains D of the two switching units Q3, Q4. The oscillating frequencies of the first and second oscillators 3041, 3042 are capable of being changed to generate the driving signals to the two switching units Q1, Q2 according to the impedances of the two switching units Q3, Q4. The first and second amplifiers 3043, 3044 are respectively connected to the first and second oscillators 3041, 3042 for amplifying the driving signals respectively and outputting the amplified driving signals to the two switching units Q1, Q2. Thus, each of the two switching units Q1, Q2 is capable of working at the corresponding frequency.

In operation, the constant current source 301 outputs the constant current to the comparator 303 and to the two LED strings 10, 20. In the embodiment, the constant current of the constant current source 301 can be adjusted by changing the resistance of the third resistor R3. The current detector 302 detects the working currents of the two LED strings 10, 20 by obtaining the currents of the first and second resistors R1, R2. The current detector 302 then outputs the working currents of the two LED strings 10, 20 to the comparator 303 to allow the comparator 303 to compare the working currents of the two LED strings 10, 20 with the constant current from the current constant source 301. The comparator then outputs the comparing result to the square wave generator 304.

The square wave generator 304 receives the comparing result and generates two corresponding driving signals based on the received comparing result to drive the two first switching units Q1, Q2 to work at the corresponding frequencies respectively. Specifically, the two switching units Q3, Q4 of the square wave generator 304 respectively receive the comparing result from the comparator 303. After the comparing result is received, the output impedances of the two switching units Q3, Q4 are changed and then are outputted to the first and second oscillators 3041, 3042 respectively. The oscillating frequencies of the first and second oscillators 3041, 3042 thus are adjusted to generate the first and second driving signals. The first and second driving signals then are amplified by the first and second amplifiers 3043, 3044 for driving the two switching units Q1, Q2 to work under the first and second frequencies respectively.

Since the two switching units Q1, Q2 work at different frequencies, therefore, the threshold frequency of the each of the first switching units can be changed to adjust the duty ratio D thereof. In this state, the difference of the threshold voltage between the two LED strings 10, 20 can be eliminated to allow the two LED strings 10, 20 to have the same brightness level. Thus, the energy consumption of each of the LED strings can be reduced and the energy converting efficiency can be improved.

The present disclosure further provides a liquid crystal display (LCD) including the above described circuit for eliminating a threshold voltage difference between two backlight LED strings.

It is to be understood, even though information and advantages of the present embodiments have been set forth in the foregoing description, together with details of the structures and functions of the present embodiments, the disclosure is illustrative only; and that changes may be made in detail, especially in matters of shape, size, and arrangement of parts within the principles of the present embodiments to the full extent indicated by the broad general meaning of the terms in which the appended claims are expressed.

What is claimed is:

1. A circuit for eliminating threshold voltage differences between backlight LED strings, comprising:

a voltage supply input;

a plurality of first switching units;

a plurality of LED strings connected to each other in parallel, one end of each of the LED strings being connected to the voltage supply input and the other end thereof being connected to the corresponding first switching unit; and a constant current controller, comprising:

a constant current source for supplying a constant current to each of the LED strings;

a current detector for detecting a working current of each of the LED strings;

a comparator for comparing the working current of each of the LED strings and the constant current from the constant current source, and outputting a comparing result; and a square wave generator for outputting driving signals of different frequencies each which is capable of driving the corresponding LED string to work at the corresponding frequency of the corresponding driving signal.

2. The circuit as claimed in claim 1, wherein each of the first switching units is a MOS transistor with a drain thereof connected to the corresponding LED string, a gate connected to the square wave generator, and a source thereof connected to current detector; and the comparator is connected to the current detector, the constant current source, and the square wave generator.

3. The circuit as claimed in claim 2, wherein the circuit further comprises a first resistor with one end thereof connected to the constant current source and the other end thereof being grounded.

4. The circuit as claimed in claim 2, wherein the circuit further comprises a plurality of second resistors, one end of each of the second resistors is connected to the source of the corresponding first switching unit, and the other end of each of the second resistors is grounded.

5. The circuit as claimed in claim 2, wherein the square wave generator comprises a plurality of second switching units and a plurality of oscillators, each of the second switching units is a MOS transistor with the gate thereof connected to the comparator, the drain thereof connected to the corresponding oscillator, and the source thereof being grounded, and each of the oscillators is further connected to the gate of the corresponding first switching unit for outputting a corresponding driving signal according to an output impedance of the corresponding second switching unit.

6. The circuit as claimed in claim 5, wherein the square wave generator further comprises a plurality of amplifiers respectively corresponding to the oscillators, each of the amplifiers is connected between the corresponding oscillator and the gate of the corresponding first switching unit of the corresponding LED string for amplifying the corresponding driving signal outputted from the corresponding oscillator.

7. The circuit as claimed in claim 6, wherein the first switching units and the second switching units are n-channel type MOS transistors.

8. The circuit as claimed in claim 7, wherein the oscillators are crystal oscillators.

9. The circuit as claimed in claim 8, wherein the circuit further comprises a constant current integrated circuit, and the constant current integrated circuit include the constant current controller and the first switching units.

10. A liquid crystal display comprising a circuit for eliminating threshold voltage differences between backlight LED strings, the circuit comprising:

a voltage supply input;

a plurality of first switching units;

a plurality of LED strings connected to each other in parallel, one end of each of the LED strings being connected to the voltage supply input and the other end thereof being connected to the corresponding first switching unit; and a constant current controller, comprising:

a constant current source for supplying a constant current to each of the LED strings;

a current detector for detecting a working current of each of the LED strings;

a comparator for comparing the working current of each of the LED strings and the constant current supplied from the constant current source, and outputting a comparing result; and a square wave generator for outputting driving signals of different frequencies each which is capable of driving the corresponding LED string to work at the corresponding frequency of the corresponding driving signal.

11. The liquid crystal display as claimed in claim 10, wherein each of the first switching units is a MOS transistor with a drain thereof connected to the corresponding LED string, a gate connected to the square wave generator, and a source thereof connected to current detector; and the comparator is connected to the current detector, the constant current source, and the square wave generator.

12. The liquid crystal display as claimed in claim 10, wherein the circuit further comprises a first resistor with one end thereof connected to an input terminal of the constant current source and the other end thereof being grounded.

13. The liquid crystal display as claimed in claim 10, wherein the square wave generator comprises a plurality of second switching units and a plurality of oscillators, each of the second switching units is a MOS transistor with the gate thereof connected to the comparator, the drain thereof connected to the corresponding oscillator, and the source thereof being grounded, and each of the oscillators is further connected to the gate of the corresponding first switching unit for outputting a corresponding driving signal according to an output impedance of the corresponding second switching unit.

14. The liquid crystal display as claimed in claim 13, wherein the square wave generator further comprises a plurality of amplifiers respectively corresponding to the oscillators, each of the amplifiers is connected between the corresponding oscillator and the gate of the corresponding first switching unit of the corresponding LED string for amplifying the corresponding driving signal outputted from the corresponding oscillator.

15. The liquid crystal display as claimed in claim 10, wherein the first switching units and the second switching units are n-channel type MOS transistors.

16. The liquid crystal display as claimed in claim 10, wherein the circuit further comprises a constant current integrated circuit, and the constant current integrated circuit includes the constant current controller and the first switching units.

* * * * *